United States Patent [19]

Segal et al.

[11] 4,070,019

[45] Jan. 24, 1978

[54] LAMINATED GAME RACKETS AND METHOD OF CONSTRUCTING SAME

[75] Inventors: Charles L. Segal; Michael G. Anderson; David N. Vincent, all of San Diego, Calif.

[73] Assignee: Groves-Kelco Sales, Inc., Minneapolis, Minn.

[21] Appl. No.: 638,743

[22] Filed: Dec. 8, 1975

[51] Int. Cl.[2] ..... A63B 49/10

[52] U.S. Cl. ..... 273/73 F; 273/DIG. 7; 273/DIG. 23

[58] Field of Search ..... 273/73 R, 73 C, 73 F, 273/DIG. 7, DIG. 23, 73 G, 73 K; 272/63; 124/23 R; 280/11.13 L

[56] References Cited

U.S. PATENT DOCUMENTS

| | | | |
|---|---|---|---|
| 1,054,059 | 2/1913 | Tunmer | 273/73 F |
| 1,094,705 | 4/1914 | Curley | 273/73 F |
| 2,029,193 | 1/1936 | Reach | 273/73 F |
| 2,878,020 | 3/1959 | Robinson | 273/73 F |
| 2,945,488 | 7/1960 | Cravotta et al. | 273/DIG. 7 |
| 3,171,397 | 3/1965 | Daly | 273/DIG. 7 |
| 3,483,055 | 12/1969 | Eshbaugh | 273/73 F X |
| 3,691,000 | 9/1972 | Kalnin | 273/73 F X |
| 3,787,051 | 1/1974 | Johns | 273/73 F |
| 3,827,689 | 8/1974 | Hyde | 272/63 |
| 3,850,156 | 11/1974 | Eicholtz | 273/73 F X |
| 3,993,308 | 11/1976 | Jenks | 273/73 F |
| 4,023,799 | 5/1977 | Van Auken | 273/73 F |

FOREIGN PATENT DOCUMENTS

| | | | |
|---|---|---|---|
| 17,462 | 5/1934 | Australia | 273/73 F |
| 1,180,866 | 1/1959 | France | 273/73 F |
| 1,940,524 | 2/1971 | Germany | 273/73 F |
| 769,606 | 3/1957 | United Kingdom | 273/73 F |
| 1,293,767 | 10/1972 | United Kingdom | 273/DIG. 23 |
| 1,312,253 | 4/1973 | United Kingdom | 273/DIG. 23 |
| 695,064 | 8/1953 | United Kingdom | 273/73 F |
| 585,489 | 2/1947 | United Kingdom | 273/73 K |
| 1,351,732 | 5/1974 | United Kingdom | 273/DIG. 23 |

OTHER PUBLICATIONS

"The Sporting Goods Dealer"; Feb. 1971; p. 256.

*Primary Examiner*—Richard J. Apley
*Attorney, Agent, or Firm*—Abrams, Berdo & Kaul Roylance

[57] ABSTRACT

A laminated game racket frame having a closed hoop-shaped inner frame and an outer frame with the outer part of the inner frame integrally bonded to the inner part of the outer frame to form a unitized body, each frame being formed as a laminate comprised of a plurality of strips. Some of these strips are made of wood, thermoplastic resin or metal, and some are made as laminates themselves from plies of reinforced thermosetting resins.

33 Claims, 8 Drawing Figures

FIG. 2
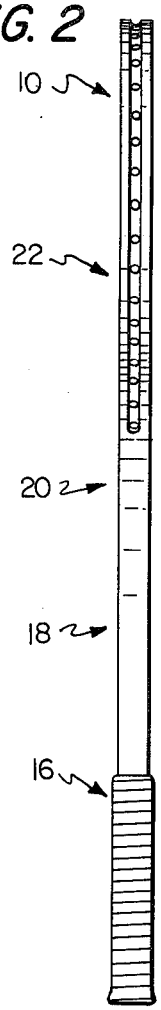
FIG. 1
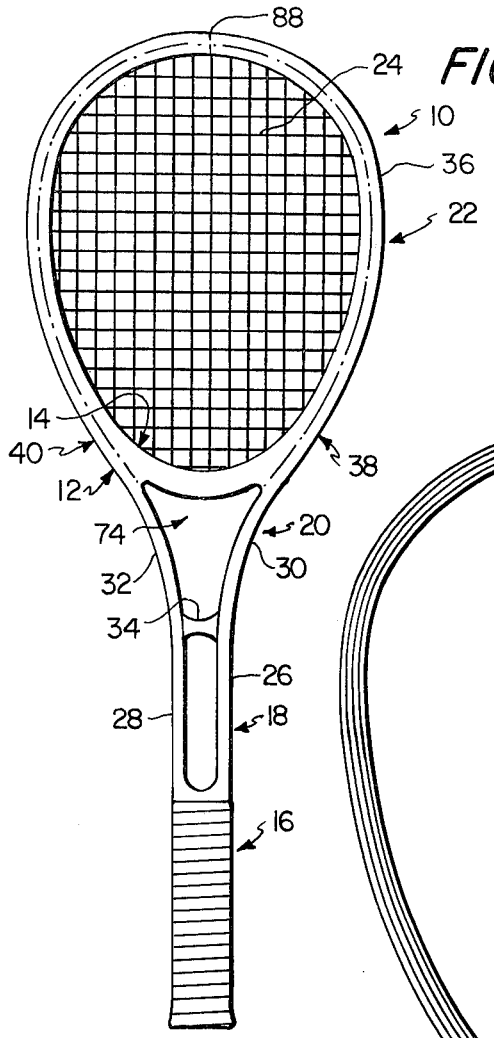
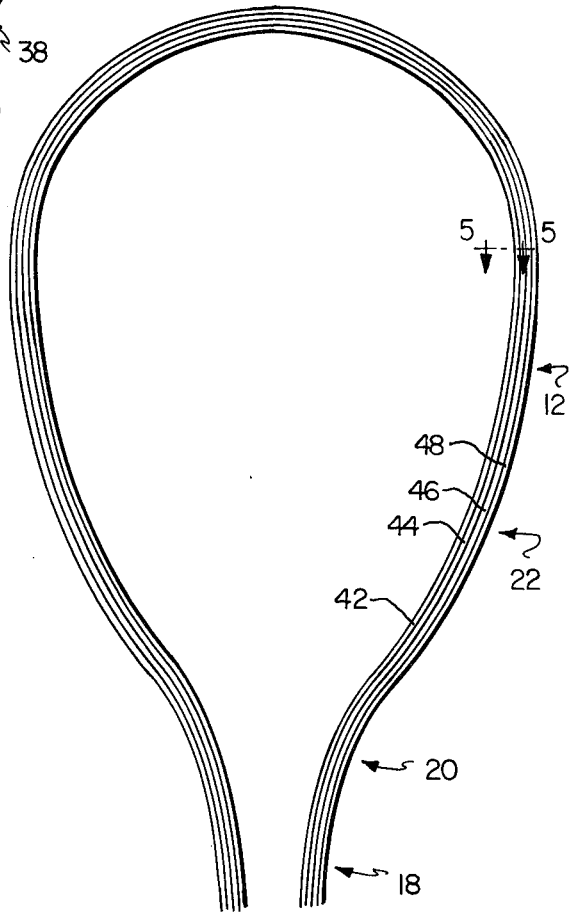
FIG. 4
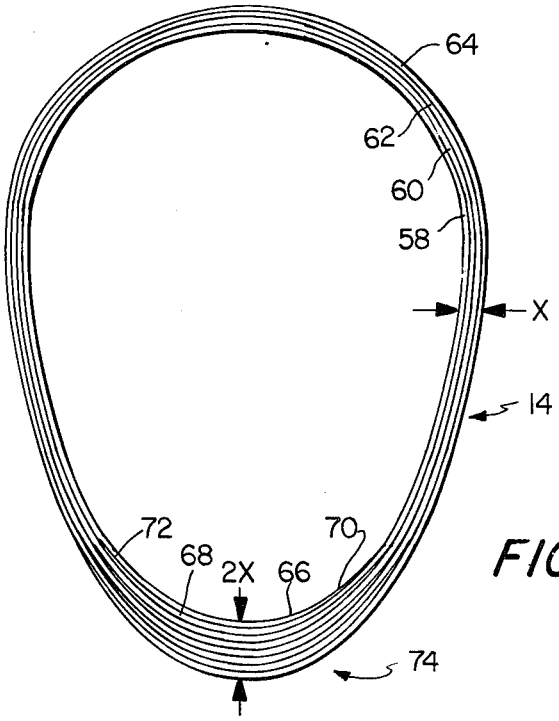
FIG. 3

LAMINATED GAME RACKETS AND METHOD OF CONSTRUCTING SAME

The present invention relates to laminated game rackets for use in tennis, racketball, squash and similar games, and more particularly relates to laminated game racket frames made of wood, metal, thermoplastic resins and reinforced thermosetting resins.

Rackets for tennis, racketball, squash and related games must have low weight combined with a high degree of stiffness and durability. In the past, many different materials have been used in the construction of these rackets including wood, aluminum, steel, fiber glass reinforced epoxy resin, graphite fiber reinforced epoxy resin, chopped fiberglass filled nylon molding compound, and the like. Each of these materials, however, presents certain advantages and certain disadvantages.

For example, wood is favored by many tennis players because of the "feel" during play, attributed to the damping or energy absorbing qualities of the wood. However, the relatively poor mechanical strength properties of wood require the utilization of large cross-sectional areas, rsulting in a bulky, clumsy-looking racket. Unfortunately, light-weight wood rackets also tend to break, especially in the yoke area where the shaft and string support are joined. Even if a wood racket fails to break, the wood tends to fatigue, and the racket becomes "dead" after a few months of serious play. Furthermore, in order to increase stiffness and strength, overlays of wood or plastic parallel to the face of a wood racket, are usually required and a streamlined "open-throat" or yoke area design is not usually possible. While aluminum rackets do provide this streamlined design, they also transmit more of the energy and shock to the player, thereby increasing the chance of injury to the player's arm or elbow. Fiber glass filled nylon rackets do provide for simplified manufacture via injection molding but usually result in significantly lower stiffness and poor durability. Additionally, many of the steel rackets tend to be too flexible, thereby decreasing the accuracy with which a player can direct his or her shot.

Accordingly, it is an object of the present invention to overcome the limitations and drawbacks associated with prior art rackets and to provide a new and improved game racket and method for constructing same.

Another object of the present invention is to provide a game racket which is low in weight while having a high degree of stiffness, strength and durability.

Another object is to provide a game racket which has a very high degree of strength in the yoke area.

Another object is to provide a game racket having the benefits of several types of material including high energy absorbing characteristics and low weight.

The foregoing objects are attained by providing a game racket comprising an outer frame and an inner frame, wherein the outer frame comprises a shaft portion, a throat portion in the form of two outwardly curving throat members, each integrally formed with the top of the shaft portion, a head portion in the form of a curvilinear rim member having two ends at the bottom thereof, each end integrally formed with the top of one of the throat members and a handle coupled to the bottom of the shaft portion; and wherein the inner frame is formed of a closed inner hoop member, the inner hoop member and the outer frame each being formed as a laminate with these laminates being integrally bonded together to form a unitized body.

Preferably, the inner and outer frames are bonded together by an adhesive comprising thermosetting resin. The strips of material forming the inner frame laminate and the outer frame laminate are also preferably bonded together by an adhesive comprising thermosetting resin so that this similar bonding between all parts of the racket result in a strong, unitized structure.

In one embodiment the strips are themselves preformed as laminates comprised of plies of glass and graphite fiber reinforced theremosetting resin. Since these thermosetting resinous strips are bonded together by an adhesive comprising a thermosetting resin, a continuously bonded system extending across the entire racket is formed, resulting in an even stronger structure.

In another embodiment some of the inner and outer frame strips are formed of wood (such as maple or shedua) which is permeable by thermosetting resin. Thus, a continuously bonded system also results when wood is combined with the fiber reinforced thermosetting resin plies.

In all embodiments, the strips forming the inner frame laminate overlap in the racket yoke area, thereby providing increased thickness and concomitant increased strength in this usually weak area.

By forming the racket of a combination of wood, graphite fiber reinforced thermosetting resin and/or glass fiber reinforced thermosetting resin, an economical racket having low weight but high strength and stiffness results. By varying the amount of each of these materials in the racket, a racket of varying characteristics may be formed. Thus, using a large proportion of graphite fiber adds stiffness at low weight, but this material is expensive. On the other hand, glass fiber is cheaper, has about the same strength, but is heavier. And finally, wood is low in cost, is light and has good energy absorbing qualities.

While various methods, as described in more detail hereinafter, can be utilized to construct the game racket which is the subject of the present invention, basically a plurality of strips of material are utilized to form, separately, the inner hoop frame and the outer frame and then these strips are cured with the inner hoop member and the outer frame being integrally bonded together to form a unitized body.

The preferred materials utilized for forming these strips include wood, metal, thermoplastic resins and reinforced thermosetting resins. The relative proportions of the various materials utilized in the construction of the game racket are dependent upon the desired properties of a specific racket. In general, however, it has been found that the various rackets can beneficially utilize from 0 to about 90% graphite fiber reinforced thermosetting resin, from about 10 to 100% fiber glass reinforced thermosetting resin, and from 0 to about 80% wood. Thus, for example, a tennis racket formed of a combination of wood, fiber glass and graphite can contain from about 25 to about 75% wood, from about 10 to about 60% fiber glass reinforced thermosetting resin, and from about 2 to about 40% graphite fiber reinforced thermosetting resin. A tennis racket to be made only from fiber glass and graphite can contain, preferably, from about 50 to about 90% fiber glass reinforced thermosetting resin and from about 10 to about 50% graphite fiber reinforced thermosetting resin. Although tennis rackets can be made by utilizing 100% fiber glass reinforced thermosetting resin, it has been found that such rackets are too flexible, at the desired weight, for most advanced players. Racketball rackets having good playing characteristics, on the other hand, can be made from 100% fiber glass reinforced thermosetting resin. However, superior performance can be obtained by the inclusion of from about ½ to about 10% graphite fiber reinforced thermosetting resin in these rackets as well as in the wood and fiber glass racketball racket.

Other objects, advantages and salient features of the present invention will become apprent from the following detailed description, which taken in conjunction with the annexed drawings, discloses preferred embodiments of the present invention.

BRIEF DESCRIPTION OF THE DRAWINGS

Referring now to the drawings which form a part of this original disclosure:

FIG. 1 is a front elevational view of a game racket constructed in accordance with the present invention;

FIG. 2 is a side elevational view of the game racket shown in FIG. 1;

FIG. 3 is an elevational view of the inner frame of the racket shown in FIG. 1, on a larger scale, showing the strips forming the inner frame with overlapping end portions;

FIG. 4 is a fragmentary elevational view of the outer frame of the racket shown in FIG. 1, on a larger scale, showing the strips forming the outer frame;

DETAILED DESCRIPTION OF THE DRAWINGS

Figure 5:
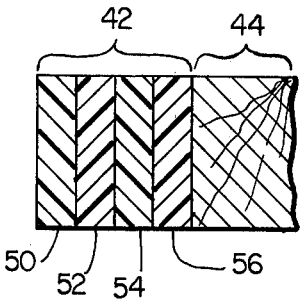
FIG. 5 is a top plan view in section taken along lines 5—5 of FIG. 4, on an even larger scale, showing the inner strip of the outer frame formed as a laminate itself as well as showing a part of the wood interior strip used to form the outer frame.

Referring to FIGS. 1 and 2, the game racket is generally designated 10 and comprises an outer frame 12 and an inner frame 14, with this inner frame being included within the phantom lines shown in FIG. 1.

The outer frame 12 comprises a handle 16, a shaft portion 18, a throat portion 20 and a head portion 22. Strings 24 for the racket are shown in FIG. 1, while they are omitted for clarity in FIG. 2.

Shaft portion 18 comprises two parallel, spaced elongated members 26 and 28 and throat portion 20 is in the form of two outwardly curving throat members 30 and 32, each integrally formed with the top of one of the shaft portion members 26 and 28. A reinforcing plate 34 is interposed between the bottom of the throat members to provide torsional rigidity to the racket. This plate is rigidly coupled at either end to these members. The head portion 22 is in the form of a curvilinear rim member 36 having two ends, generally designated at 38 and 40 at the bottom thereof, each end integraliy formed with the top of one of the throat members. The handle 16 can be conventional and is coupled to the bottom of the shaft portion 18.

Referring now to FIG. 4, an enlarged view of the outer frame 12 shows that it is constructed of a plurality of strips rigidly bonded together, including inner strip 42, interior strips 44 and 46, and outer strip 48. While only four strips are shown in FIG. 4, any number can be utilized, with the thickness of any strip being as desired.

Referring now to FIG. 5, an enlarged sectional view of the outer frame of FIG. 4 shows that the inner strip 42 can itself be formed as a laminate by means of a plurality of plies 50, 52, 54 and 56. These plies, formed of material to be described in more detail hereinafter, are rigidly bonded together and, while only four are shown in FIG. 5, can be of any desired number. Additionally, while not shown, the outer strip 48 can also be formed of a plurality of plies, as well as any of the interior strips. As shown in FIG. 5, the interior strip 44 adjacent inner strip 42 is made of wood, while it is also could be made of metal or of the same material as strip 42.

Referring now to FIG. 3, the enlarged view of the inner frame 14 shows that this frame is formed as a closed inner hoop member having a periphery corresponding to the inner surface of the upper part of the outer frame 12 shown in FIG. 4. The inner frame 14, as in the outer frame 12, is formed as a laminate from a plurality of strips, including inner strip 58, interior strips 60 and 62 and outer stri 64. While only four strips are shown in FIG. 3, any desired number of strips can be utilized with their individual thicknesses varying as desired. Additionally, the materials utilized to form the individual strips can be those to be described in more detail hereinafter. Additionally, any of the strips utilized to form the inner frame can themselves be formed as a laminate from a plurality of plies, similar to that described above regarding the outer frame 12 and the subject matter shown in FIG. 5. Thus, the inner frame or hoop 14 is a laminate comprising a plurality of adhesively bonded, distinct strips of material which are arranged perpendicular to the faces of the racket which they form.

As specifically shown in FIG. 3, each strip utilized to form the inner frame 14 has overlapping opposite end portions, for example, end portions 66 and 68 on inner strip 58, with these end portions having reduced thicknesses 70 and 72 at the ends thereof. Because of these overlapping end portions, that portion of the inner frame 12 forming the yoke area 74 at the bottom of the frame 12 is twice as thick as the remaining portions of the frame, as shown in FIG. 3 by a 2X showing the thickness of the yoke area 74 and an X showing the thickness of the frame in a portion thereof spaced from the yoke area. As shown in FIG. 1, the yoke area 74, at the bottom of the inner frame 14, is adjacent the throat portion 20.

Thus, when the inner frame 14 and the outer frame 12 are bonded together, by bonding the outer strip 64 of the inner frame and the inner strip 42 of the outer frame, a unitized body is formed with the yoke area 74 having a thickness substantially equal to the combined thicknesses of the remainder of the inner frame 14 and the curvilinear rim member 36.

Figure 6:
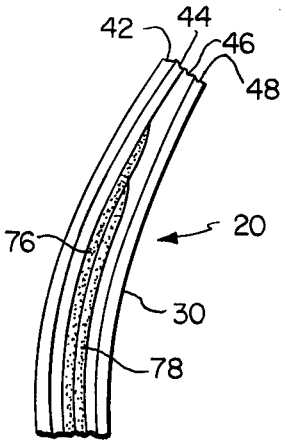
FIG. 6 is an enlarged fragmentary front elevational view of the throat member of the racket shown in FIG. 1 which has been reinforced.

Referring now to FIG. 6, the throat member 30 is shown having a plurality of reinforcing strips 76 and 78 interposed between the two interior strips 44 and 46 utilized to form the outer frame 12. These reinforcing strips can be made of wood, metal or reinforced thermosetting resin and are adhesively bonded together as well as to the interior strips 44 and 46.

Figure 7:
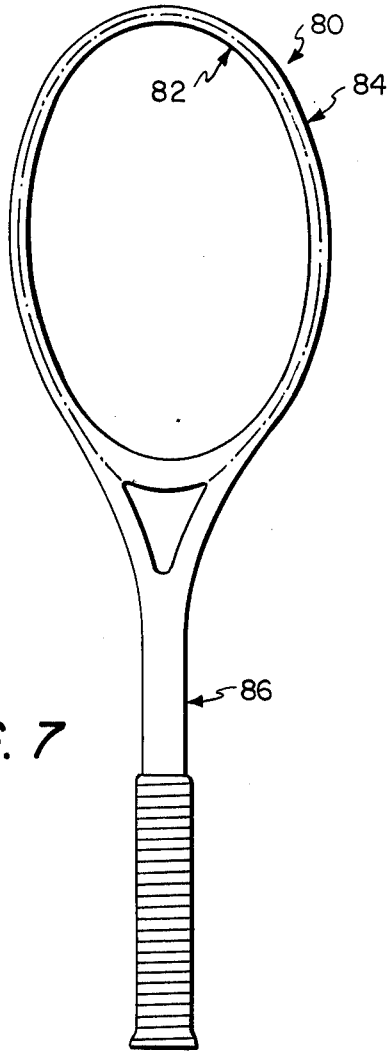
FIG. 7 is a front elevational view of a game racket constructed in accordance with the present invention and similar to that shown in FIG. 1 except having an oval inner frame and a solid shaft portion.

As shown in FIG. 7, a game racket 80 having an oval inner frame 82 and an oval curvilinear rim member 84 can be constructed in accordance with the present invention. This modified game racket also discloses a solid shaft portion 86. In general, any desired curvilinear head shape can be combined with either an open or solid shaft portion and either an open or solid throat area.

MATERIALS USED TO FORM THE GAME RACKET

Almost any material that can be obtained in the form of this strips having sufficient flexibility to be bent into the desired shape of the game racket and being capable of adhesive bonding can be utilized.

Thus, wood veneers, such as maple, ash, bamboo, teak and the like can be utilized. Additionally, use can be made of metals such as steel, aluminum, magnesium and their related alloys.

Additionally, thermoplastic resins can be utilized such as polyvinyl chloride, acrylonitrile-butadiene-styrene, nylon, polyacetal, polyester, polycarbonate and the like, with or without added fillers, glass, graphite, and the like reinforcements and plasticizers.

Finally, reinforced thermosetting resins, such as fiber glass, graphite fiber, boron fiber, paper, cotton fabric, synthetic fiber and the like impregnated with epoxy, polyester, phenolic or similar thermosetting resins can be utilized. Additionally, these thermosetting resins can also include microballoons of glass, phenolic resin, or the like, so as to form a syntactic foam of reduced density, with or without the above reinforcements.

These four types of materials, i.e., wood, metal, thermoplastic resins and reinforced thermosetting resins, can be used alone or in combination to provide the desired properties to the structure.

Thus, the various strips utilized to form the inner frame 14 and the outer frame 12 can be formed of any one of these materials or a combination thereof.

The most desirable material to use in the game racket is the fiber glass reinforced epoxy resin, used together with graphite fiber reinforced epoxy resin and/or wood. Conventionally, both fiber glass and graphite fiber are obtained in the form of "prepreg", i.e., fiber preimpregnated with uncured epoxy resin. The fibers may be unidirectional, i.e., all running in the same direction, or woven fabric. Unidirectional fibers give the best mechanical properties in the direction parallel to the fibers, but are extremely weak in the transverse direction. This can be commpensated by utilizing multiple plies set at different angles. Woven cloth, on the other hand, provides somewhat poorer properties in the primary direction, but is must stronger in the transverse direction.

Unidirectional graphite fiber reinforced epoxy resins have an exceptionally high modulus of elasticity (stiffness) together with a high strength and a low specific gravity. Graphite fiber, however, is moe fragile than fiber glass and has poor elongation, poor scuff resistance and low tensile elongation. Additionally, it is many times the cost of other fibrous reinforcements. Thus, it has been found most beneficial to combine impregnated graphite fiber with other impregnated reinforcements to form a hybrid laminate with a desirable balance of properties.

For example, unidirectional fiber glass is used as the outer ply to provide good scuff resistance and hardness to the surface, while woven fabrics are included to provide strength in the transverse direction. Graphite fiber plies and Kevlar, a high strength, high modulus aromatic polyamide fiber, plies are included as desired to provide increased stiffness with low added weight.

The "prepregs", referred to above, are soft pliable materials that can be easily cut with a hand scissors and shaped to the desired contour. The application of heat and pressure to the prepreg causes the resin therein to cure, producing a hard, strong rigid material. However, the maximize the mechanical properties of the cured laminate to be utilized in the game racket, uniform pressure must be applied during the curing process in order to avoid resin rich and resin poor areas within the laminate, and also a high curing temperature must be used. Thus, for ease of production of high strength flaw-free laminates, it has proven most beneficial to cure them as thin flat sheets. These sheets are then cut to strips of desired width, coated with thermosetting adhesive, shaped around a forming tool, and cured again.

The strips utilized to form the inner and outer frames of the game racket 10 can be produced in any desired thickness from about 0.005 inch to about 0.200 inch, preferably from about 0.020 to about 0.080 inch, and can, themselves, be composed of several different plies of materials as described previously.

METHODS OF CONSTRUCTING THE GAME RACKET

Several alternative methods, all of them satisfactory, can be utilized to join the inner frame 14 and the outer frame 12 so as to provide an integral bond therebetween forming a unitized body for the racket frame. The three methods discussed below differ, essentially, in the process step in which the bonding occurs, which can be a discrete step or one occuring concurrently with other steps. In any event, all of the methods are based on forming both the inner and outer frames as liminates of a plurality of strips adhesively bonded together, some or all of these strips themselves being preformed as laminates by bonding together a plurality of plies of reinforced thermosetting resins.

In the first method the inner frame 14 and the outer frame 12 are each formed separately and cured under the influence of heat and pressure so as to form rigid structures of the desired shape. The outer frame 12 can be cured as a single unit, or as two separate pieces as would be illustrated by dividing the outer frame 12 shown in FIG. 4 along the longitudinal centerline thereof. In either case, the inner and outer frames are subsequently adhesively bonded together using, for example, an epoxy resin adhesive. Additionally, if the outer frame is cured as two separate pieces, these pieces would additionally be bonded together as well as to the inner frame 14. Thus, this first method comprises the steps of applying a plurality of thermosetting adhesive coated inner hoop strips about a form, heating the strips under pressure to cure them into a laminate of the desired form, applying a plurality of thermosetting adhesive coated outer frame strips about a form corresponding to the outer configuration of the cured inner hoop laminate, heating the outer frame strips under pressure to cure them into a laminate, and adhesively bonding the outer surface of the outermost of the inner hoop strips to the inner surface of the innermost outer frame strips under the influence of heat and pressure, utilizing the same thermosetting adhesive as above.

In the second method, the inner frame 14 is subjected to heat and pressure so as to cure it into a rigid structure of the desired shape and then utilizing the cured inner frame as part of the shaping form, the outer frame 12 strips are formed around the cured inner frame in the desired shape and subjected to heat and pressure so as to cure it into a rigid structure. During this last mentioned curing step, the innermost outer frame strip is concurrently bonded to the outermost inner frame strip. Thus, this second method comprises the steps of applying a plurality of thermosetting adhesive coated inner hoop strips about a form, heating the strips under pressure to cure them into a laminate of the desired form, applying a plurality of thermosetting adhesive coated outer frame strips around at least a part of the outer surface of the cured inner hoop, and heating the outer frame strips under pressure to cure them into a laminate and simultaneously adhesively bonding the innermost outer frame strip to the outermost inner frame strip.

Finally, in the third method, the inner frame strips are shaped around a suitable form, but are not cured. The outer frame strips are then formed around the uncured inner frame strips and the whole structure is subjected to heat and pressure so as to cure all components, simultaneously, into a rigid, unitized body, with the inner and outer frame being bonded together. Thus, the method comprises the steps of applying a plurality of thermosetting adhesive coated inner hoop strips about a form, applying a plurality of thermosetting adhesive coated outer frame strips about at least a part of the outer surface of the inner hoop, and simultaneously heating the inner hoop strips and the outer frame strips under pressure to cure them and adhesively bond them together.

While the foregoing methods provide rackets of essentially the same characteristics, it is apparent that the third method requires less processing steps than the second method which, in turn, requires less than the first method. This is offset by the complexity of the required tooling and forms which increases as the number of processing steps are decreased. However, even the most complex tooling, as required in the third method, is much simpler and less costly than the precision matched metal dies and autoclaves required for the production of rackets directly from prepreg rather than the use of precured laminate strips as described herein.

EXAMPLES

Example I - Preparation of Laminates from Individual Plies

Sheets or plies of various fibers or fabrics, preimpregnated with epoxy resin ("prepreg") were cut to 12 inch by 72 inch strips which were stacked into a laminate in the order illustrated in the following table:

| Laminate No. | Composition | Nominal Thickness |
|---|---|---|
| 1 | UG/UGr/UGr/120G/120G/120G | 0.043 in. |
| 2 | UG/120G/UG/120G/UG/120G/120G/120G | 0.064 in. |
| 3 | UG/UGr/UGr/UGr/UGr/120G/120G | 0.043 in. |
| 4 | UG/120G/UG/120G/120G | 0.041 in. |
| 5 | 120G/120G/181K/181K/181K/181K/120G/120G | 0.072 in. |

UG=Unidirectional glass fiber impregnated with epoxy resin, 0.013 inch per ply after curing.
UGr=Unidirectional graphite fiber impregnated with epoxy resin, 0.005 inch per ply after curing.
120G=Style 120 weave fiber glass fabric impregnated with epoxy resin, 0.005 inch per ply after curing.
181K=Style 181 weave Kevlar fabric impregnated with epoxy resin, 0.013 inch per ply after curing.

Each stack of strips was covered with sheets of Tedlar release film, placed between two thin stainless steel caul plates and inserted into a press which had been preheated to 325° F. The press was pressurized to 20 psi initially, and increased by 10 psi increments every five minutes to 50 psi, where it was held for an additional 45 minutes. The laminate was cooled under pressure to 150° F. and removed from the press. A sheet metal shear was used to trim the edges and cut strips of the desired width.

Example II - Graphite/Glass/Wood Composite Laminated Tennis Racket

A. Construction of Inner Frame Forming Tool

An elliptical doughnut having an outside dimension and contour equal to those desired for the inside of the racket inner frame was cut and milled from 1 inch aluminum sheet stock. The circumference of the ellipse was 30.5 inches.

B. Construction of Frame Press 90 (shown in FIG. 8)

Four ¾-inch thick pieces of plywood were laminated together to form a 3-inch thick piece which was then cut in two pieces following the contour of one-half of the racket frame, as illustrated by the contour on one side of the longitudinal centerline of FIG. 4. The female side 92 of the contour, shown in FIG. 8, was lined with a 3 inch wide strip 94 of 0.02 inch thick stainless steel and the male side 96 lined with a piece of heavy-duty 3 inch wide fire hose 98 sealed at one end and attached to an air inlet valve 100 at the other end. Pivoted steel bars 102 were mounted on both sides to clamp the two pieces of the press 90 together.

C. Construction of Racket Inner Frame

To form the inner frame of the racket two 1-inch wide, 36 inches long strips of Laminate No. 1 of Example I were sanded on the fabric side of the laminate to give a 0.040 inch thickness and the last 2 inches of each end feathered. Epoxy resin adhesive was spread on the sanded side of these laminates and also on each side of two 1-inch side strips of 0.050 inch thick maple veneer, the ends of which had also been feathered. The four strips were stacked together, placing the two maple strips in the center of the sandwich.

The inner frame forming tool, described above, was sprayed with a mold release agent and wrapped circumferentially with a strip of cellophane film to prevent excess adhesive from bonding the part to the aluminum form. The four strips were then centered and clamped at the top of the ellipse, and shaped by bending and clamping the sides, finally overlapping and interleaving the strips at the bottom.

Beginning at the top of the ellipse, the aluminum form with the four circumferentially clamped strips was overwarpped, torrodially, with shrink tape for several inches in each direction. The tape was heated with a hot air gun to cause it to shrink and apply pressure to the strips. The overwrapping was continued down each side, removing clamps as necessary and shrinking the tape periodically until the entire inner frame was wrapped and uniformly compacted. A steel band was then clamped, circumferentially, around the inner frame and the entire construction placed in an oven at 250° F. for two hours to cure.

After removal from the oven, the inner frame was allowedto cool to below 130° F. and then removed from the form. The pressure generated by the shrink tape together with that generated by the thermal expansion of the aluminum doughnut against the steel band was sufficient to provide good bonding between the strips.

D. Construction of Racket Outer Frame

To form the outer frame of the racket, the following 2-1/16-inch wide strips were stacked together, in the order indicated, after applying epoxy resin adhesive to both sides of all mating surfaces:

a. Laminate No. 1, 0.040 inch thick by 31 inches long.
b. Maple Veneer, 0.050 inch thick by 31 inches long.
c. Shedua Wedge, 0.187 inch thick by 19 inches long.
d. Maple Wedge, 0.050 inch thick by 18.75 inches long.
e. Shedua Wedge, 0.187 inch thick by 18.5 inches long.
f. Maple Veneer, 0.050 inch thick by 31 inches long.
g. Laminate No. 1, 0.050 inch thick by 31 inches long.

Wedges *c, d* and *e* were tapered on one side from full thickness to essentially zero thickness over a 9-inch length and stacked, together with the other strips, with the thick ends flush with one end of the stack.

The stack of adhesive coated strips was covered with cellophane of Mylar film to prevent sticking and placed in the female half 92 of the frame press 90, described previously and illustrated in FIG. 8, with strip a) against the steel liner 94 and the wedges on the flat side of the press (the right side as illustrated in FIG. 8). The male half 96 of the press was put in place and the press clamped together with the steel bar clamps 102, causing the strips to conform to the contour of the press. The hose lining 98 on the male side 96 of the press was inflated with compressed air to a pressure of 80 psi. The loaded press was then placed in an oven at 225° F. for four hours to cure the epoxy adhesive. After removal from the oven, the racket frame was allowed to cool to below 130° F. under pressure and then removed from the press.

E. Assembly of Racket Inner and Outer Frames

The 2-1/16-inch outer frame lamination was sawed longitudinally in half to provide two 1-inch wide frame halves. The curved ends of these outer frames halves were trimmed to size so that they form an even butt joint at point 88 of FIG. 1. The inside contour of the outer frame and the outside contour of the inner frame were sanded to provide a good bonding surface, coated with an epoxy resin adhesive, and assembled as illustrated in FIG. 1. The inner frame and outer frame of the assembled racket were wrapped torroidally with shrink tape, as described eariler, and the wrapping continued around the remainder of the racket. The wedge inserts that had been incorporated in the outer frame resulted in the two halves of the frame coming together and joining in the handle as shown in FIG. 7. The shrink tape was overwrapped with a rubber strip under tension to provide additional pressure and the assembly cured in an oven at 175° F. for three hours. The assembly was removed from the oven, cooled and the wrappings removed. The racket was sanded to 0.700 inch thickness, and the end of the handle trimmed to give an overall length of 27 inches. Stringing holes were drilled around the circumference of the rim 36, and a string-groove milled circumferentially in the center of the top portion of the rim to countersink and protect the strings 24.

The handle 16 of the racket was drilled with holes to adjust the overall weight and balance of the racket, the handle inserted into a silicone rubber mold and the handle contour formed with polyurethane foam of 12 pound per cubic foot density. Finally, the racket was sanded, the wood sections filled, and the racket sprayed with a polyurethane varnish. After wrapping the handle with leather grip material and stringing, the finished racket weighed 13.25 ounces, and had a very high stiffness, low torque, and good durability. In addition, the wood composite structure provided excellent easthetics.

Example III - Graphite/Glass/Wood Composite Laminated Racketball Racket

The following 2.5-inch wide strips were feathered on each end and stacked together, in the order indicated, after applying epoxy resin adhesive to both sides of all mating surfaces:

a. Laminate No. 1, 0.040 inch thick by 32 inches long.
b. Maple Veneer, 0.050 inch thick by 31 inches long.
c. Maple Veneer, 0.050 inch thick by 31 inches long.
d. Laminate No. 2, 0.050 inch thick by 31.5 inches long.

A collapsible inner frame forming tool was constructed in a similar manner as described for the Inner Frame Forming Tool of Example II, with the exception that it was made 3 inches thick, machined to the desired dimensions and contour of the inside of the racketball racket, and segmented into four movable sections actuated by a center mounted cam. The circumference of the tool measure 26.125 inches.

The stacked strips were bent, circumferentially, around the collapsed tool, previously lined with cellophane or Mylar film to prevent sticking, with strip a) located adjacent to the tool surface, and the bottom ends of the strips interleaved as shown in FIG. 3. A 3-inch wide fire hose, sealed on both ends and with an air inlet valve and a steel liner strip on the back, was circumferentially clamped around the strips, the inner frame tool expanded, the hose pressurized to 80 psi with air and the assembly placed in an oven at 250° F. for three hours to cure the strips. The assembly was removed from the oven, allowed to cool to below 130° F., the hose deflated and removed, the forming tool collapsed and the cured laminated inner frame removed.

Figure 8:
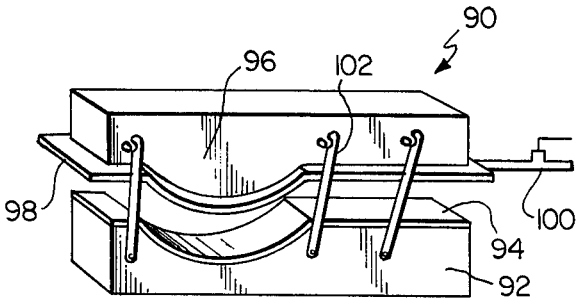
FIG. 8 is a perspective view of a mold utilized to shape the strips forming the outer frame of the game racket.

An outer frame press was constructed in a similar manner as that described in Example II and illustrated in FIG. 8, with the exception that two female forms were used, ie.e, the contour side 92 of FIG. 8 was identical to that of side 96, and that the inflatable hose 98 was one continuous piece lining both halves of the press.

The following 2.5-inch wide strips were stacked together, in the order indicated, after applying epoxy resin adhesive to both sides of all mating surfaces, as well as to the outside surface of ply e):

e. Laminate No. 2, 0.050 inch thick by 46 inches long.
f. Maple Veneer, 0.050 inch thick by 46 inches long.

g. Maple Veneer, 0.050 inch thick by 46 inches long.

h. Laminate No. 4, 0.040 inch thick by 46 inches long.

The outside surface of the already cured inner frame was sanded, coated with epoxy resin adhesive, and placed on a bench and the two halves of the frame press centered around it. the stacked strips were formed, symmetrically, around the inner frame with ply e) located adjacent to the inner frame and both ends terminating in the flat handle section of the press. Two additional stacks of 2. 5 inch strips, coated with adhesive on all surfaces, each composed of the following materials, were prepared:

i. Shedua Wedge, 0.125 inch thick by 11 inches long.

j. Maple Wedge, 0.050 inch thick by 10.75 inches long.

k. Shedua Wedge, 0.125 inch thick by 10.5 inches long.

These wedges were tapered on one side from full thickness to essentially zero thickness over a 5-inch length and stacked with all thick ends together.

One stack of wedge strips was inserted between the two maple strips, f) and g), with the thick ends of the wedges flush with the ends of the other strips. In a similar manner, the second stack of wedge strips was inserted between the other ends of strips f) and g).

The frame press was clamped together, the hose pressurized to 80 psi with compressed air, and the assembly placed in an oven at 225° F. for four hours to cure the adjesive.

After cooling under pressure to below 130° F., the racket was removed from the press and sawed, parallel to the face of the racket, into three equal sections, each about 0.8-inch thick. Each racket was sanded, so as to taper from 0.700-inch at the handle to 0.625-inch at the top end of the racket, and the handle end trimmed to give an overall length of either 19.25 (long) or 18.25 inches (regular). Stringing holes were drilled around the circumference of the rim 36 and a string-groove milled circumferentially in the center of the top portion of the rim 36 to countersink and protect the strings. The handle contour was formed with polyurethane foam as described above in Example II.

Finally, the rackets were sanded, the wood sections filled and the rackets sprayed with polyurethane var- The following 1-inch wide strips were feathered on each end and stacked together, in the order indicated, after applying epoxy resin adhesive to both sides of all mating surfaces:

a. Laminate No. 3, 0.035 inch thick by 37 inches long.

b. Laminate No. 2, 0.060 inch thick by 37 inches long.

c. Laminate No. 3, 0.035 inch thick by 37.5 inches long.

The stacked strips were formed around the tool, wrapped with shrink tape, and clamped, as described in Example II, and cured in an oven at 300° F. for two hours.

The outer surface of the cured hoop was sanded, spread with adhesive and replaced on the aluminum doughnut form which was bolted to a steel positioning bar. An aluminum throat spacer bar, machined to the desired inner dimensions and contour of the open throat and shaft portions illustrated in FIG. 4, was also bolted to the positioning bar in contact with the yoke area 74 of the inner frame.

The following 1-inch wide strips were stacked together, in the other indicated, after applying epoxy adhesive to both sides of all mating surfaces, as well as to the outside surface of ply (d):

d. Laminate No. 3, 0.035 inch thick by 62.5 inches long.

e. Laminate No. 2, 0.060 inch thick by 63 inches long.

f. Laminate No. 3, 0.035 inch thick by 63 inches long.

The stacked strips were then clamped around the combinated inner frame and throat spacer and the following strips, with feathered ends, inserted in the handle area between strips e) and f), as illustrated by reinforcing strips 76 and 78 in FIG. 6, on both sides of the throat portion 20:

g. Laminate No. 2, 060 inch thick by 21.25 inches long.

h. Laminate No. 3, 0.035 inch thick by 20.75 inches long.

i. Laminate No. 3, 0.035 inch thick by 20.25 inches long.

The assembled form was wrapped with shrink tape and cured in an oven at 250° F. for three hours. After cooling to below 130° F., the racket was removed from the form. The handle end of the racket was trimmed to

[redacted]

While various advantageous emboidments have been chosen to illustrate the present invention, it will be understood by those skilled in the art that various changes and modifications can be made therein without departing from the scope of the invention as defined in the appended claims.

What is claimed is:

1. A game racket frame comprising:
an outer frame including
a shaft portion,
a throat portion in the form of two outwardly curving throat members, each integrally formed with the top of said shaft portion,
a head portion in the form of a curvilinear rim member having two portions at the bottom thereof, each portion integrally formed with the top of one of said throat members, and
a handle coupled to the bottom of said shaft portion; and
an inner frame formed of a closed inner hoop member;
said inner hoop member being formed as a laminate,
said outer frame being formed as a laminate, and
means for bonding said inner hoop member and said outer frame together to form a unitized body,
said inner hoop member laminate comprising a plurality of adhesively bonded, distinct strips of material, said strips being arranged perpendicular to the faces of said racket, at least one of said strips comprising a preformed, precured strip of fiber reinforced thermosetting resin,
said outer frame laminate comprising a plurality of adhesively bonded, distinct strips of material, said strips being arranged perpendicular to the faces of said racket, at least one of said strips comprising a preformed, precured strip of fiber reinforced thermosetting resin.

2. A game racket frame according to claim 1 wherein said fiber comprises graphite fiber 3. A game racket frame according to claim 1 wherein said fiber comprises fiber glass.

4. A game racket frame according to claim 1 wherein said fiber comprises graphite fiber and fiber glass.

5. A game racket frame according to claim 1 wherein some of said strips are formed of thermoplastic resins.

6. A game racket frame according to claim 1, and further including
a plurality of reinforcing strips coupled to said outer frame along at least a portion of said throat portion.

7. A game racket frame according to claim 1 wherein said inner hoop member has a thickness at the bottom which is substantially twice the thickness of the remaining parts of said inner hoop member.

8. A game racket frame according to claim 1 wherein said inner hoop member laminate comprising an inner strip, an outer strip and a plurality of interior strips located between said inner and outer strips,
said inner and outer strips being preformed, precured laminates of fiber reinforced thermosetting resin,
at least one of said interior strips being formed of wood; and
said outer frame laminate comprising an inner strip, an outer strip and a plurality of interior strips located between said inner and outer strips,
said inner and outer strips being preformed, precured laminates of fiber reinforced thermosetting resin.

9. A game racket frame according to claim 8 and further including
a plurality of reinforcing strips coupled to said outer frame along said shaft portion and at least a part of said throat portion, said reinforcing strips being comprised of wood.

10. A game racket frame according to claim 1 wherein
each strip of said inner hoop member is a laminate of fiber reinforced thermosetting resin; and
each strip of said outer frame is a laminate of fiber reinforced thermosetting resin.

11. A game racket frame according to claim 10 and further including
a plurality of reinforcing strips coupled to said outer frame along said shaft portion and at least a part of said throat portion.

12. A game racket frame according to claim 1 wherein
said inner hoop member laminate and said outer frame laminate are formed from 0 to about 90% graphite fiber reinforced thermosetting resin, from about 10 to 100% fiber glass reinforced thermosetting resin and from 0 to about 80% wood.

13. A game racket frame according to claim 1 wherein
said inner hoop member laminate and said outer frame laminate are formed from about 25% to about 75% wood, from about 10% to about 60% fiber glass reinforced thermosetting resin and from about 2% to about 40% graphite fiber reinforced thermosetting resin.

14. A game racket frame according to claim 1 wherein
said inner hoop member laminate and said outer frame laminate are formed from about 10% to about 90% fiber glass reinforced thermosetting resin and from about 10% to about 90% graphite fiber reinforced thermosetting resin.

15. A game racket frame according to claim 1 wherein
said inner hoop member laminate has an outermost strip which comprises a first fiber reinforced thermosetting resin, and
said outer frame laminate has an innermost strip which comprises a second fiber reinforced thermosetting resin.

16. A game racket frame according to claim 15 wherein
said first and second fiber reinforced thermosetting resins are the same.

17. A game racket frame according to claim 15 wherein
said first and second fiber reinforced thermosetting resins are epoxy.

18. A game racket frame according to claim 17 wherein
said means for bonding comprises an epoxy thermosetting resin.

19. A game racket frame according to claim 1 wherein
said means for bonding includes a thermosetting resin.

20. The game racket frame according to claim 19 wherein said thermosetting resin is epoxy.

21. A game racket frame according to claim 19 wherein said thermosetting resin is polyester.

22. A game racket frame according to claim 19 wherein said thermosetting resin is phenolic.

23. A game racket frame according to claim 19 wherein at least one of said inner hoop member laminate strips comprises wood which is permeable by the thermosetting resin bonding these inner hoop member laminate strips together, and at least one of said outer frame laminate strips comprises wood which is permeable by the thermosetting resin bonding these outer frame laminate strips together.

24. A game racket frame according to claim 1 wherein said at least one strip additionally comprises a plurality of plies comprising at least one ply of glass fiber reinforced thermosetting resin and at least one ply of graphite fiber reinforced thermosetting resin.

25. A game racket frame according to claim 24 wherein some of said fibers are unidirectional and some are woven.

26. A game racket frame according to claim 24 wherein the outermost strip in said outer frame laminate comprises glass fiber reinforced thermosetting resin.

27. A game racket frame comprising:

a shaft portion;

a throat portion;

a head portion in the form of a curvilinear rim member having two portions at the bottom thereof, said portions being integral with the top of said throat portion;

a handle coupled to the bottom of said shaft portion; and support means, coupled at least to said throat portion, for reinforcing said frame, said head portion comprising a plurality of adhesively bonded, distinct strips of material, said strips being arranged perpendicular to the faces of said racket, at least one of said strips comprising preformed, precured fiber reinforced thermosetting resin.

28. A game racket frame according to claim 27 wherein at least one of said strips is formed of wood.

29. A game racket frame according to claim 27 wherein at least one of said strips is formed of metal.

30. A grame racket frame according to claim 27 wherein said fiber comprises graphite fiber.

31. A game racket frame according to claim 27 wherein said fiber comprises fiber glass.

32. A game racket frame according to claim 27 wherein said fiber comprises fiber glass and graphite.

33. A game racket frame according to claim 32 wherein said shaft, throat and head portions comprise at least two spaced apart strips each comprising a preformed, precured strip of fiber reinforced thermosetting resin.

* * * * *